US006585398B1

(12) United States Patent
Haddad

(10) Patent No.: US 6,585,398 B1
(45) Date of Patent: Jul. 1, 2003

(54) POST TOP DECK LIGHT FIXTURE

(75) Inventor: Eric O. M. Haddad, East Berlin, PA (US)

(73) Assignee: Genlyte Thomas Group, LLC, Louisville, KY (US)

( * ) Notice: Subject to any disclaimer, the term of this patent is extended or adjusted under 35 U.S.C. 154(b) by 0 days.

(21) Appl. No.: 09/887,607

(22) Filed: Jun. 22, 2001

(51) Int. Cl.[7] ..... F21V 5/00

(52) U.S. Cl. ..... 362/328; 362/152; 362/297; 362/253; 362/328

(58) Field of Search ..... 362/145, 152, 362/296, 297, 253, 326, 327, 328, 332, 341

(56) References Cited

U.S. PATENT DOCUMENTS

| | | | | | |
|---|---|---|---|---|---|
| 114,513 | A | | 5/1871 | Aronson | |
| 187,423 | A | * | 2/1877 | Shirley | 362/327 |
| 1,201,108 | A | * | 10/1916 | Smith | 362/297 |
| 3,222,509 | A | | 12/1965 | Thedford | |
| 3,278,743 | A | * | 10/1966 | Franck | 362/297 |
| 3,328,579 | A | | 6/1967 | Green | |
| 3,866,034 | A | | 2/1975 | Russo | |
| 4,028,542 | A | * | 6/1977 | McReynolds, Jr. | 362/297 |
| 4,462,068 | A | | 7/1984 | Shadwick | |
| 4,969,074 | A | | 11/1990 | Davis et al. | |
| 5,055,987 | A | * | 10/1991 | Ellson et al. | 362/277 |
| 5,274,537 | A | | 12/1993 | Altman | |
| 5,398,180 | A | | 3/1995 | Lee | |
| 5,701,236 | A | | 12/1997 | Viviano | |
| 5,833,351 | A | | 11/1998 | Neville | |
| 5,887,856 | A | | 3/1999 | Everly, II | |
| 6,033,089 | A | | 3/2000 | Tesauro | |
| 6,152,579 | A | * | 11/2000 | Reed et al. | 362/320 |

OTHER PUBLICATIONS

US 4,447,864, 5/1984, Smith et al. (withdrawn)

* cited by examiner

*Primary Examiner*—Sandra O'Shea
*Assistant Examiner*—Sharon Payne

(57) ABSTRACT

A post top deck light fixture having a user adjustable reflector which allows a user to adjust light distribution in a desired manner. The fixture comprises a base, a refractor having at least one prismatic surface, a reflector having a light blocking member depending therefrom by a perforated connection, and a roof.

24 Claims, 4 Drawing Sheets

POST TOP DECK LIGHT FIXTURE

BACKGROUND OF THE INVENTION

1. Technical Field of the Invention

The present invention relates to a Post Top Deck Light Fixture having a user adjustable reflector and refractor optics such that light is uniformly directed downward illuminating a deck and railing or is directed only at a desired deck area.

2. Description of the Related Art

Generally, there are several patents which disclose post-top luminaries that combine lighting with fencing. These generally involve a hollow post, a light fixture, a plurality of means for attaching the fixture to fencing including numerous clamps, and complicated wiring schemes. For instance, U.S. Pat. No. 5,887,856 to Everly II, is for an illuminated fence system. The fence system is a modular pre-fabricated system having lights receivably positioned within fence posts and light lenses mounted within fence rails. In this embodiment sensors also mounted in fence posts activate lights which in turn illuminate fence rail lenses.

U.S. Pat. No. 5,701,236 to Viviano discloses an illuminated railing system. In this embodiment a light source is mounted within a fence post. Light is transmitted from the light source through transmission rods which are located within the fence rails.

U.S. Pat. No. 3,222,509 to Thedford is for an illuminated fence wherein a plurality of decorative housing fixtures are each mounted atop vertical fence posts.

In a related art electric luminaries are used to decorate decks, sidewalks, driveways, paths and the like during festivities such as birthdays, Halloween, or Christmas. These generally involve usable lights mounted along an electric conductor wherein each light is maintained within a shell and staked through an aperture in the shell to the ground. Moreover, various types of festive covers or sleeves can be placed over the shell to celebrate numerous holidays or festivities.

SUMMARY OF THE INVENTION

It is an object of the present invention to provide a post top deck light fixture.

It is a further object of the present invention to provide a post top deck light fixture which can be adjusted by the end user to distribute a desired pattern of light.

It is a further object of the present invention to have reflectors and refractor optics which allow an end user to adjust light distribution in a desired pattern.

It is a further object of the present invention to have formed perforated reflector pieces which allow a consumer to remove panels so that light patterns can be adjusted.

More particularly a post top deck light fixture is provided, comprising a base having a top surface, a bottom surface, and side surfaces, a refractor mounted to the base and extending to a roof, a user-adjustable reflector receivably mounted beneath the roof, and the roof removably fastened to the fixture.

The reflector further comprises a light blocking member depending from a peripheral edge of said reflector. The light blocking member is connected along at least one perforated edge.

The reflector is made of semi-specular aluminum, specular aluminum, or some other reflective material and is mounted on an interior side of the roof.

The refractor comprises at least one prismatic surface and preferably has an internal prismatic surface with vertically extending prisms and an external prismatic surface with horizontally extending prisms.

The base has a lamp socket centrally aligned on the top surface of the base. The roof may have a decorative final centrally mounted atop the roof.

All of the above outlined objectives are to be understood as exemplary only and many more objectives of the invention may be gleaned from the disclosure herein. Therefore, no limiting interpretation of the objectives noted is to be understood without further reading of the entire specification and drawings included herewith.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENT

Figure 1:
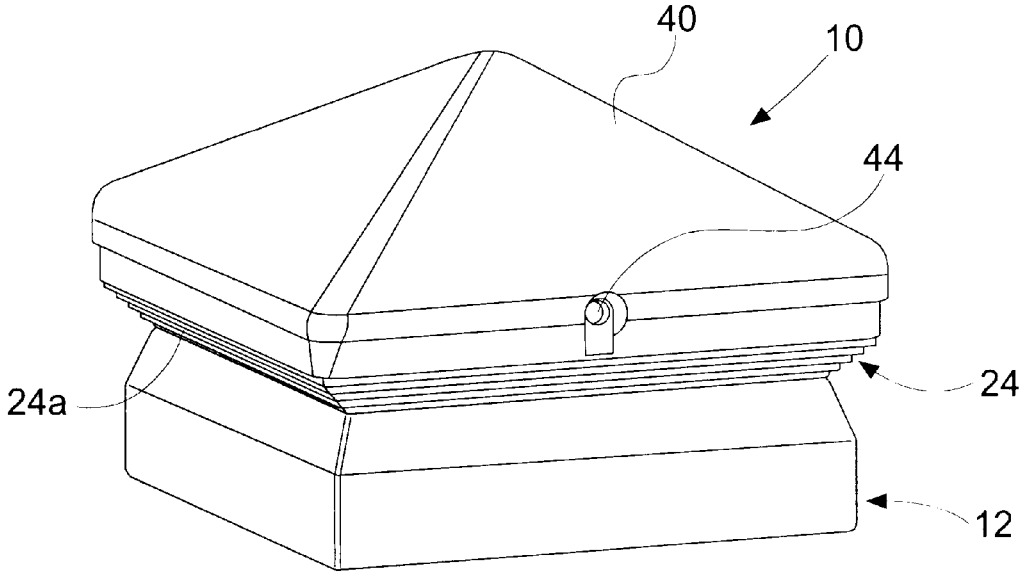
FIG. 1 is a perspective view of the post top deck light of the present invention.
Figure 2:
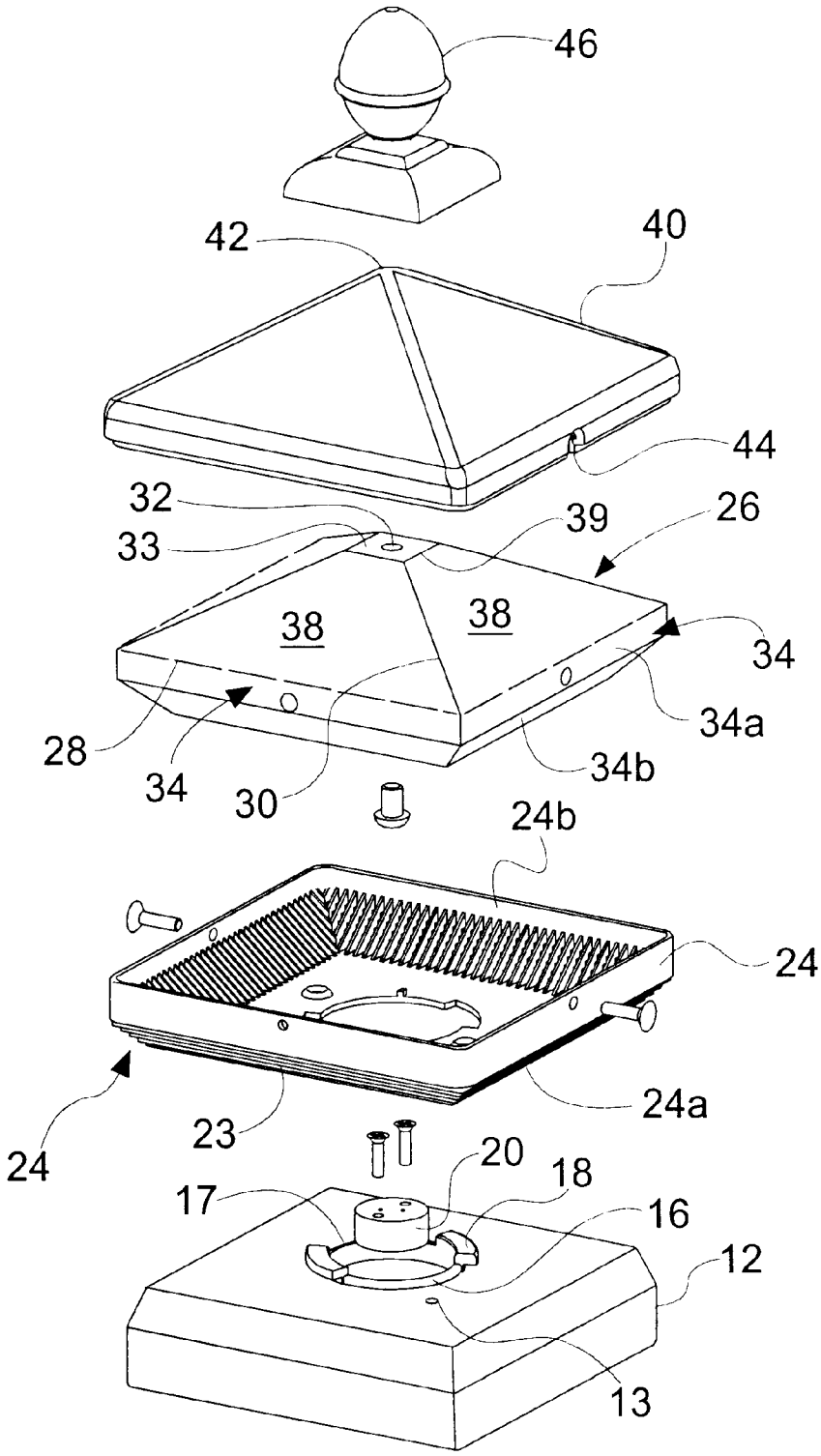
FIG. 2 is an exploded view of the post top deck light of FIG. 1.
Figure 3:
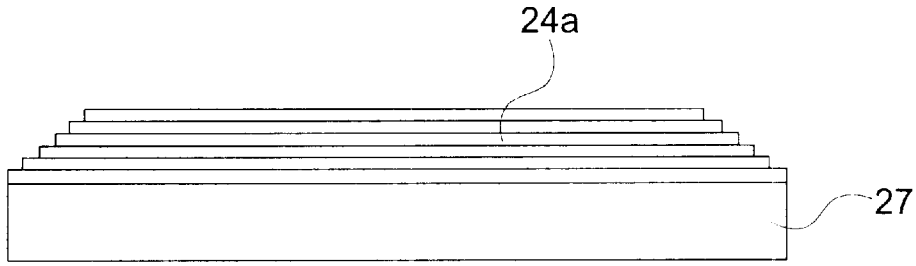
FIG. 3 is a side view of the refractor for the post top deck light of FIG. 1.
Figure 4:
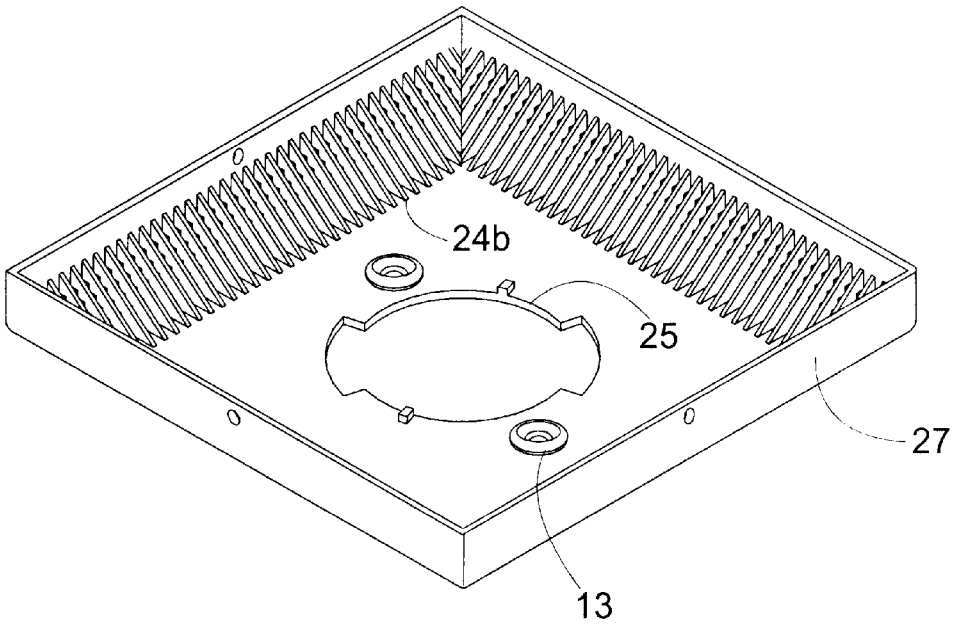
FIG. 4 is a top perspective view of the refractor shown in FIG. 3.
Figure 5:
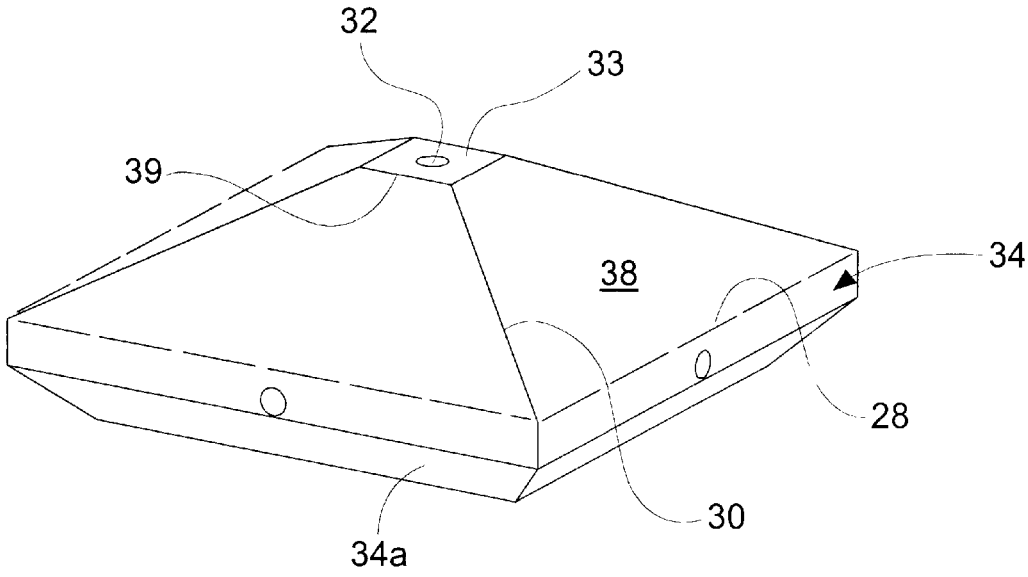
FIG. 5 is a perspective view of the reflector of the post top deck light shown in FIG. 2.

Initially FIG. 1 shows one embodiment of a Post Top Deck Light 10 of the present in venation. A base 12 of the deck post light fixture 10 may be composed of a decorative yet durable, weather resistant material to keep out weather elements such as rain, snow, wind, ice, and the like. Preferably, the base 12 is made of die-cast brass.

A base 12 is shown in a square configuration of about 4 inches×4 inches for mounting above a 4 inch by 4 inch (10.16 cm×10.16 cm) wooden deck post (not shown). The base 12 generally has a top surface, a bottom surface, and four sides. The top surface has a refractor mounting member 16 centrally aligned and extending therefrom. The refractor mounting member 16 has a generally hollow cylindrical shape with locking tabs 18 extending radially from a top peripheral edge 17 of the refractor mounting member 16. Within the hollow area of the refractor mounting member 16 is a lamp socket 20. The lamp socket 20 is in electrical communication with an electrical wire (not shown) providing power, preferably from a low voltage power source (not shown). Lamp (not shown) is receivably connected to lamp socket 20, preferably by pins, and therefore is in electrical communication with the electrical wire (not shown) and the power source (not shown). The lamp (not shown) can for instance be a 10 watt Bi-pin halogen lamp while the fixture is for example rated for 20 watts. Finally, the base 12 has at least one screw hole 13 for mounting a refractor 24 and the base 12 to a wooden post.

Extending from the base 12 to the roof 40 is a prismatic lens or refractor 24 preferably made of a clear durable polycarbonate material. One skilled in the art will recognize that various materials can be used and that refractor 24 may be many different designs not necessarily requiring the refraction of light and may therefore include a simple light emission or transmission window. Refractor 24 is mounted to the top surface of base 12 and preferably has an inverted frustopyramidal shape. Refractor 24 has a lower horizontally flat surface 23, angled sidewalls comprising external prisms 24*a* and internal prisms 24*b*, and vertical sidewalls 27. Along a lower horizontally flat surface of refractor 24 there is a cut out area or key 25 which fits over refractor mounting member 16. When the refractor 24 is placed on the base 12 and over the key 25, the refractor 24 is out of alignment with the base 12 by about 45 degrees, for example. By rotating the refractor 24 by about 45 degrees, the locking tabs 18 hold the refractor 24 against the base 12 and align holes 13' with base holes 13. Thus a screw (not shown) can be inserted through holes 13' and 13 into a wooden post (not shown).

The sidewalls of refractor 24 are angled due to the frusto-pyramidal shape of the refractor 24 and are comprised of external and internal prismatic surfaces 24*a* and 24*b*. The external prismatic surface 24*a* may extend upward and outward in a stepped configuration from the lower horizontally flat surface 23 to the vertical sidewalls 27 and may have horizontally extending prisms. On an internal side of the refractor 24 is internal prismatic surface 24*b*. The internal prismatic surface 24*b* also extends from the lower horizontally flat surface 23 to vertical walls 27. The external prismatic surface 24*a* and internal prismatic surface 24*b* in cooperation provide light distribution such that one looking at the fixture does not see a single light source but rather an evenly distributed glow emitting from the entire refractor 24 area. Of course, any refractor design may be utilized depending on the environment, light direction or user specifics desired for light output of the post top deck light desired.

Housed within the refractor 24 is a reflector 26 which may be made of specular aluminum, semi-specular aluminum, or some other reflective material. Reflector 26 has a frustopyramidal shape having a flat top 33 with hole 32 therein for fastening the reflector 26 to a roof 40, and four sides 38. Reflector 26 further comprises a light blocking member 34 depending from a bottom peripheral edge of each reflector side 38. Light blocking member 34 is comprised of a vertical member 34*a* and an angled member 34*b*. The vertical member 34*a* blocks light from passing through vertical walls 27 and angled member 34*b* prevents light from passing through internal and external prismatic surfaces 24*a* and 24*b*. This embodiment is exemplary and any configuration may be used such that light cannot pass through refractor 24.

The light blocking member 34 is connected to reflector 26 by perforations 28 along the lower peripheral edges of reflector 26. The perforations 28 allow light blocking members 34 to be removed if desired. Thus, if a user does not want light along a side of the reflector 26, the light blocking member 34 is left in place along the side where darkness is desired. If light is desired along a side of the reflector 26, the light blocking member 34 can be removed along the perforations 28.

The four sides 38 of reflector 26 are not connected along their long edges. Instead the sides 38 are connected to the peripheral edges 39 of top 33 and there are slits 30 along each connecting edge of sides 38. Connecting edge 39 between top 33 and side member 38 is such that side member 38 may be readily removed from reflector 26 and is frangibly connected thereto. Perforations 28 allow only the lower portion 34 to be removed depending of the light output configuration desired. In this configuration, the sides 38 can be removed. Removing a reflector side 38 has the effect of reducing the amount of incident light directed toward the refractor 24, resulting in a less light output. Although the roof 40 is preferably metal, it does not reflect light in as efficiently a manner as the reflector 26, resulting in less light output from the fixture 10. Thus, through a combination of removing side members 38 and the removable lower light blocking member 34, light output may be adjusted to desired direction or user specification.

The design of the present invention therefore sets forth a post top deck light fixture in which light emitted from the lamp (not shown) or other light source is reflected off of the reflector 26 and then downward through the refractor 24 in a direction which has been defined by the user through separation of side members 38 or light blocking members 34 from the reflector. By removing these panels off of the reflector, light is allowed to escape desired faces of the refractor so that the user can direct light output where desired. Further, light is transmitted through the refractor 24 in a diffused manner, depending on the type of refractor utilized, but other flat light emission or transmission windows may be utilized depending on the light effect desired.

Over the base 12 is a roof 40 having a substantially pyramidal shape with an exemplary lower dimension of about 5 inches by 5 inches (12.7 cm×12.7 cm). The roof 40, like the base 12, is preferably made of die cast brass for durability. Located within at least one side of the roof 40 is a fastening hole 44. The fastening hole 44 preferably allows the roof 40 to be removably attached to the refractor 24 and reflector 26. This allows access to internal electrical components like lamp 22 as well as user adjustment of the reflector 26. Also located in the upper apex of roof 40 is a fastening hole 42 for fastening the reflector 26 through hole 32. The fastening hole 42 can also be used to connect a decorative final 46, for a more decorative appeal. The height of the fixture 20 without the final is for example about three and one-quarter inches, and the height with the final is about five inches. However, one skilled in the art will recognize that these measurements can vary. In this embodiment roof 40 fits over reflector 26 and vertical sidewalls 27 so that internal and external prismatic surfaces 24*a* and 24*b* are exposed.

To summarize, the present invention provides a Post Top Deck Light Fixture having reflector and refractor optics which together direct light in a downward direction to optimally light a deck railing. More specifically the fixture has reflectors and refractor optics which allow an end user to distribute light in a desired pattern. The reflector has perforations which allow a user to remove panels as desired such that the user can adjust the light pattern.

The forgoing detailed description is primarily given for clearness of understanding and no unnecessary limitations are to be understood therefrom for modifications will become obvious to those skilled in the art upon reading this disclosure and may be made without the parting from the spirit of the invention or the scope of the appending claims.

I claim:

1. A post top deck light fixture, comprising:

a refractor affixed to a base member, said refractor attached to a roof member, said roof member having a reflector mounted to an interior surface thereof wherein said reflector has a plurality of side members, said side members removable from said reflector, at least one light blocking portion depending from a lower edge of said side members and separated from said side members by a plurality of perforations, said light blocking portions each disposed along an inner surface of said refractor.

2. The light fixture of claim 1 wherein said reflector is further comprised of four side members.

3. The light fixture of claim 2 wherein said side members are separated from each other by a slit along a first and a second side.

4. The light fixture of claim 2 wherein said reflector further has a top, each of said four side members frangibly connected to said top.

5. The light fixture of claim 4 wherein said reflector is removably connected to said interior surface of said roof member.

6. A post top deck light fixture comprising a base portion, a roof and light emission area there between, a reflector mounted to the interior surface of said roof, said reflector having a plurality of sides depending from a top portion, each of said side removably affixed to said top portion, at least one light blocking portion frangibly connected to a lower edge of said plurality of side and positioned along at least one interior surface of said refractor.

7. The fixture of claim 6, said at least one interior surface of said refractor being light mission area.

8. The fixture of claim 7 wherein said light emission area is a refractor.

9. The fixture of claim 8 wherein said reflector and said roof are pyramidal.

10. The fixture of claim 9 wherein each of said side members of said reflector is separated from an adjacent side by a slit.

11. The fixture of claim 10 wherein said slit between said adjacent sides extends along an entire side edge of said side members.

12. A post top deck light fixture, comprising:

a refractor affixed to a base member, said base member adapted to be mounted onto the top surface of a post top, said refractor attached to a roof member, said roof member having a reflector mounted on an interior surface thereof, wherein said reflector has a plurality of side members frangibly connected near a top portion of said reflector, at least one light blocking portion depending from a lower edge of each of said side members and separated from said side members by a perforated edge, each of said at least one light blocking portions covering at least one interior surface of said refractor.

13. The post top deck light fixture of claim 12 wherein said base member has a top wall and depending side walls forming a hollow area therebetween, said hollow area receiving said top surface of a post top.

14. A post top deck light fixture, comprising:

a refractor affixed to a base member, said base member having a top wall and depending side walls and adapted to mount to a top surface of a post top, said refractor attached to a roof member, said roof member having a reflector mounted on an interior surface thereof, wherein said reflector has a plurality of side members, each of said side members frangibly connected to a top portion of said reflector and having a light blocking portion depending downwardly from a bottom edge, said light blocking portion disposed within said refractor and inhibiting light from passing there through, at least one light blocking portion depending from a lower edge of said side members and separated from said side members by a plurality of perforations, said light blocking portions each disposed along an inner surface of said refractor.

15. The light fixture of claim 14 wherein said light blocking portion is separated from said side member by a plurality of perforations.

16. The light fixture of claim 14 wherein said reflector and said roof are pyramidal in shape.

17. A post top deck light fixture, comprising:

a base having a top surface and side surfaces;

a refractor mounted to said base and extending to a roof;

a user-adjustable reflector having at least one removable side member receivably mounted adjacent an inner surface of said roof;

said roof removably fastened to said refractor;

said reflector having at least one light blocking portion depending downwardly from a perforated bottom peripheral edge of said side member and disposed against at least one interior surface of said refractor.

18. The post top deck light fixture of claim 17, wherein said reflector further comprises a light blocking member depending from a peripheral edge of said reflector.

19. The post top deck light fixture of claim 18, wherein an internal prismatic surface has vertically extending prisms and an external prismatic surface having horizontally extending prisms.

20. The post top deck light fixture of claim 17 further comprising a lamp socket centrally aligned on said top surface of said base.

21. The post top deck light of claim 17 where said reflector is mounted on an interior side of said roof.

22. A post top deck light fixture, comprising:

a base having a top surface and side surfaces;

a refractor mounted to said base and extending to a roof, said refractor having at least one prismatic surface;

a user-adjustable reflector receivably mounted to an inner surface of said roof;

said roof removably fastened to said fixture;

wherein said reflector further comprises a light blocking member depending from a peripheral edge of said reflector;

said light blocking member being removably connected along at least one perforated edge and positioned along the inner surface of said refractor inhibiting light from passing outwardly there through.

23. The post top deck light fixture of claim 22, wherein an internal prismatic surface comprises vertically extending prisms and an external prismatic surface is comprising horizontally extending prisms.

24. The post top deck light fixture of claim 22, further comprising a lamp socket centrally aligned on said top surface of said base.

* * * * *

UNITED STATES PATENT AND TRADEMARK OFFICE

CERTIFICATE OF CORRECTION

PATENT NO. : 6,585,398 B1
DATED : October 17, 2003
INVENTOR(S) : Eric O.M. Haddad It is certified that error appears in the above-identified patent and that said Letters Patent is hereby corrected as shown below:

Column 2,
Line 6, delete "final" and replace with -- finial --;
Line 36, delete "in venation" and replace with -- invention --;
Line 36, delete sentences, "A base 12 of the deck post light fixture 10 may be composed of a decorative yet durable, weather resistant material to keep out weather elements such as rain, snow, wind, ice, and the like. Preferably, the base 12 is made of die-cast brass";

Column 5,
Lines 14 and 16, delete "side" and replace with -- sides --;
Line 19, after "being" insert -- a --;
Line 46, delete "a" and replace with -- said --;

Signed and Sealed this

Twentieth Day of January, 2004

JON W. DUDAS
*Acting Director of the United States Patent and Trademark Office*